US005566913A

United States Patent [19]

Prokop

[11] Patent Number: 5,566,913

[45] Date of Patent: Oct. 22, 1996

[54] WRIST REST APPARATUS

[76] Inventor: David M. Prokop, 20713 NE. 38th St., Redmond, Wash. 98053

[21] Appl. No.: 455,386

[22] Filed: May 31, 1995

[51] Int. Cl.[6] ..... A47F 5/00

[52] U.S. Cl. ..... 248/118

[58] Field of Search ..... 248/118, 118.1, 248/118.3, 118.5, 918; 400/715

[56] References Cited

U.S. PATENT DOCUMENTS

| | | | |
|---|---|---|---|
| 4,545,554 | 10/1985 | Latino | 248/118.1 |
| 5,125,606 | 6/1992 | Cassano | 248/918 X |
| 5,158,255 | 10/1992 | Fuller | 248/118 |
| 5,163,646 | 11/1992 | Engelhardt | 248/118 |
| 5,356,099 | 10/1994 | Sereboff | 248/918 X |
| 5,435,508 | 7/1995 | Deuitch | 248/118 |
| 5,445,349 | 8/1995 | Hart | 248/118 |

*Primary Examiner*—Alvin C. Chin-Shue
*Assistant Examiner*—Sarah L. Purol
*Attorney, Agent, or Firm*—Gregory W. Hauth

[57] ABSTRACT

An improved wrist rest (10) is disclosed for reducing repetitive motion strain injuries on the wrists of a typist or computer keyboard operator. Wrist rest (10) is located in front of and parallel to a keyboard (60) or other typing device such that the wrist or wrists (15) of a user is (are) positioned directly over the wrist rest (10) while typing. Wrist rest (10) consists of an elastic envelope (40) filled with a gelatinous material (50) which provides cushioned support for a user's wrists while maintaining the wrist or wrists in a relatively straight position. In some embodiments the gelatinous material (50) can be chilled or heated to provide a source of cold or heat for a period of time. The gelatinous material (40) can be held in place by a base support means (20). In some embodiments wrist rest (10) can be grasped with both hands and squeezed, propelling the gelatinous material within the elastic envelope, thereby functioning as an exercise means for the hands and fingers of the hands.

19 Claims, 4 Drawing Sheets

WRIST REST APPARATUS

BACKGROUND-FIELD OF THE INVENTION

The invention relates to the field of apparatus that reduce the severity of symptoms involving injuries to the hands and wrists as a result of performing repetitive hand and wrist motions, common while typing on a computer keyboard. The invention relates specifically to a wrist rest that supports the wrist, exercises the hands, and reduces inflammation to decrease the severity of symptoms associated with repetitive motion strain injuries like Carpal Tunnel Syndrome.

BACKGROUND-DESCRIPTION OF PRIOR ART

The widespread use of personal computer keyboards has increased occurrences of repetitive motion stress injuries such as Carpal Tunnel Syndrome. The Carpal Tunnel is a sheath type membrane that passes over a U-shaped structure composed of bone and cartilage located in the wrist of a human that allows the median nerve, tendons and other tissues of the arm to pass over the wrist joint to the hand. In general terms, Carpal Tunnel Syndrome is an injury caused by the inflammation of tendons, nerves, and other tissue passing through the Carpal Tunnel. An increase in edema and inflammation of tissues in the wrist area accelerates this pathophysiological process. Progression of this typical repetitive motion injury can lead to permanent damage to nerves, tendons, joints, and muscles of wrists and hands. Symptoms can include chronic and acute pain in wrists and hands, loss of the range of motion of wrists and hands, loss of nerve function, atrophy of the muscles of the hands, and loss of functionality of the wrists and hands.

One element of repetitive motion stress injuries is wrist position while typing. Repetitive motion stress injuries may occur while typing on a keyboard continuously over a long period with the wrist in a bent position. Bending the wrist exerts increased pressure and strain on the tendons and nerve in the Carpal Tunnel. Repetitive motion causes edema, tissue stress and irritation. Prolonged irritation further leads to swelling of the tissues, which in turn leads to constriction of the median nerve inside the Carpal Tunnel. The inflammation and constriction continue until the median nerve is damaged. The median nerve exhibits damage to the typist usually as a tingling feeling or as a sharp pain in the wrist or hand. Carpal Tunnel Syndrome usually manifests itself as pain from the thumb and next three fingers, radiating to the elbow. Pain can range from minor itching and stiffness to acute periods of white-hot pain in the wrist and hand. Current strategies to relieve the symptoms include: positioning wrists in a neutral or straight position while typing; taking frequent rest periods from typing; exercising the hands and wrists; taking aspirin to reduce inflammation; injecting anti-inflammatory drugs; and performing surgery.

DESCRIPTION OF PRIOR ART

Inventors have created several types of devices that follow the first strategy mentioned above to reduce the occurrence and severity of Carpal Tunnel Syndrome. For example, U.S. Pat. No. 5,356,099 to Sereboff describes a wrist rest that includes a liquid pack. The '099 patent presents a wrist rest system to reduce the: compression loading of the median nerve from either internal or external sources through interface of the user's appendage. Unfortunately, the '099 patent presumes that load forces applied to the wrist area compress the median nerve and therefore lead to Carpal Tunnel Syndrome. Current knowledge indicates instead that Carpal Tunnel Syndrome is a condition created by repetitive motion of the hands and wrists, which in turn causes inflammation of the wrist tissue leading to constriction of the median nerve. Thus, compression loads on the wrist area of the magnitude found, for example, during typing, do not directly develop into Carpal Tunnel Syndrome.

In addition, U.S. Pat. No. 5,234,186 to Powell (1993), U.S. Pat. No. 5,131,614 Garcia et al. (1993) and U.S. Pat. No. 5,209,452 to Goldberg (1993) have each proposed various embodiments of wrist rests to position the wrist correctly in an attempt to relieve or avoid Carpal Tunnel Syndrome. U.S. Pat. No. 5,158,255 (1992) to Fuller describes an invention useful as a wrist rest and as an exercise device. However, the device of the '255 patent uses for its core a solid, rigid material that cannot bend. Fuller's device therefore does not reduce inflammation of the wrist area, is not comfortable, and does not provide an effective means for exercise.

Much of the prior art suffers from a number of disadvantages regarding alleviation of Carpal Tunnel Syndrome. For example, the '186 patent to Powell, the '614 patent to Garcia et al., the '452 patent to Goldberg and the '255 patent to Fuller provide for an ergonomically correct wrist position as the only method to eliminate Carpal Tunnel Syndrome. Unfortunately, while wrist rests are in common use, Carpal Tunnel Syndrome remains a common injury among typists. The prior art over-simplifies the pathophysiological cause of Carpal Tunnel Syndrome as attributable solely to incorrect wrist position. Rather, any device must correct the underlying condition: inflammation of the wrist. To illustrate problems with the prior art, if a typist maintains good ergonomic position of his or her wrist and arms and types continuously for several hours, increased pressure inside the Carpal Tunnel will still develop. This may be due to the mechanical stress of repeatedly rubbing the flexor tendons against the Carpal Tunnel ligament. The repeated rubbing of the flexor tendons causes increased pressure and inflammation of the tendons and, if left untreated, will lead to Carpal Tunnel Syndrome. Correct ergonomic position of the wrist while typing does not eliminate inflammation of the wrist tissues. What is needed is a wrist rest that helps reduce pressure on the wrist and reduce or eliminate inflammation and which also provides a means of exercising the muscles of the hands and wrists. The invention disclosed herein helps reduce pressure and inflammation by providing a source of cold to a user's wrist while the user is typing or between periods of typing. A disadvantage of prior art wrist rests is that they are not designed to be chilled and used as an effective source of cold. Prior art wrist rests are manufactured from solid blocks of foam rubber, a material that reflects body heat back to the wrist area. Heating the wrist area can cause sweating of the wrists and hands, which increases fluid retention, edema, and therefore, pressure the wrist. The disadvantage of Prior art devices is that they tend to increase inflammation and so contribute to the progression of Carpal Tunnel Syndrome.

A further disadvantage of prior art wrist rests is that they do not readily deform to the shape of the user's wrist and therefore produce an uncomfortable pressure point between the wrist rest and the user's wrist. The materials for prior art wrist rests, such as solid pieces of neoprene or foam rubber blocks, also do not allow for curving or bending of the wrist rest. A disadvantage of such prior art wrist rests is they cannot bend or be shaped to fit irregularly shaped keyboards. Prior art wrist rests are therefore limited to effective use with only presently available straight keyboards. A further disadvantage is that a user cannot easily adjust or compress the thickness of prior art wrist rests. If the thickness of the wrist rest does not exactly match the thickness of the keyboard, only a relatively minimal contact area or pressure point will be established between the wrist rest and the user's wrist and accordingly the wrist will be maintained in an incorrectly bent positioned.

A further disadvantage of prior art wrist rests made of pieces of solid neoprene or foam rubber is that their shape does not anticipate or accommodate grasping by the hands for effective exercising of wrists and hands. The '255 patent discloses a device with a generally cylindrical core for providing a relatively rigid form that can be used as a means to exercise the wrists as well. However, the use of a core comprised of solid materials provides limited exercise capability, since it can be squeezed a relatively minimal degree. In addition, prior art devices do not provide dynamic resistance. For example, foam rubber material of prior art wrist rests are too stiff for a weak person to use as an exercise means. Conversely, foam rubber might be too soft for a strong person to use as an exercise means. The invention disclosed herein combines an elastic, gelatinous core to provide dynamic resistance for people having varying degrees of strength.

A further disadvantage of the prior art is that the fabric coverings on prior art wrist rests cannot be easily removed for effective cleaning or sterilization of germs.

Yet another disadvantage is that prior art wrist rests cannot be effectively adhered to the surface of a keyboard.

Still another disadvantage is prior art wrist rests are not designed to be easily integrated into a keyboard design or integrated into keyboard manufacturing processes. Prior art wrist rests use rigid materials such as foam rubber manufactured with specific length, width, and thickness for positioning the device on a table surface in front of the keyboard. A disadvantage of using rigid material for wrist rests is a new wrist rest must be manufactured to conform to the shape of a new curved keyboard. Prior art wrist rests manufactured with rigid materials become obsolete with each new keyboard design, and do not provide long term value to their users. Another disadvantage of prior art wrist rests manufactured from rigid materials is that a user cannot shape the wrist rest into a position that is suitable for the user's individual needs for comfort and support for the size and shape of the user's wrist and arm.

OBJECTS AND ADVANTAGES

It is an object of the present wrist rest to relieve a user of the causes of Carpal Tunnel Syndrome by providing a wrist rest comprising an elastic envelope filled with a thermally conductive gelatinous material that can easily conform to the shape of a user's wrist, which is comfortable, and which eliminates pressure points associated with rigid wrist rests. It is another object of the present invention to provide a gelatinous device that a user can grasp with both hands and which will provide a means to exercise the wrist by propelling the gelatinous material inside the elastic envelope from one hand through the envelope to the other hand. The user can control the flow of the gelatinous material by holding the wrist rest firmly with one hand and squeezing with the other hand. By opening and closing the hands against resistance, hands and fingers receive a dynamic resilient quality over a large hand and finger range of motion. It is a further object of the invention to provide a thermally therapeutic device to reduce inflammation by providing a source of cold or a heat source (to provide a means to increase superficial blood flow to a user's skin) as desired. It is yet a further object to provide a wrist rest apparatus having a removable outer covering. It is a further object of the invention to provide a covering that can include a variety of surfaces such as rubber bumps or a slippery surface to enhance tactility (as an exercise device) or surface seating (as a wrist rest.) It is another object to provide a wrist rest with an ability to deform and bend into numerous positions to allow its use with bent or irregularly shaped keyboards. It is another object to provide a wrist rest which has internal support members for added strength and maintain form for use on an inclined surface.

REFERENCE NUMERALS IN DRAWINGS

10 wrist rest

Figure 1:
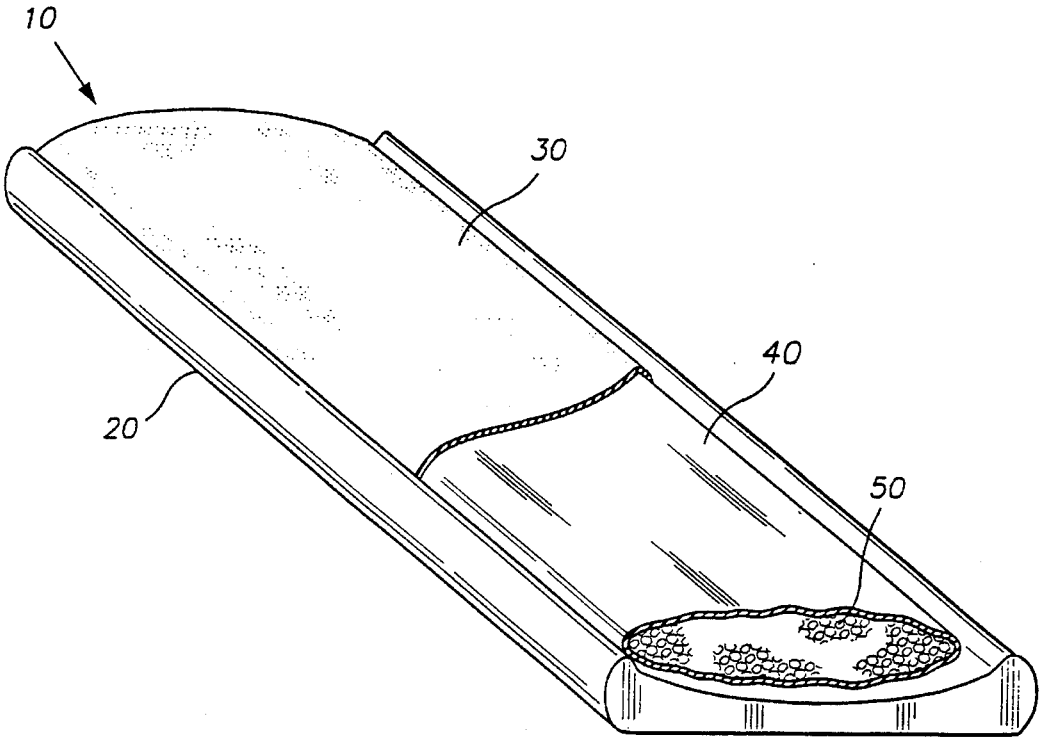
FIG. 1 a perspective view of a particular embodiment of the present wrist rest, with the wrist rest held in a base support with a concave surface.

15 (*a*), (*b*) user's wrist and hand

20 base support

20 (*a*) base support having a concave surface in communication with wrist rest

20 (*b*) base support having a flat surface in communication with wrist rest

20 (*c*) base support provided by extended, inclinded surface of a keyboard with adhesive surface(s) and having a flat surface in communication with wrist rest.

20 (*d*) base support, having deformable support material embedded within

30 outer covering

32 rubber feet

34 suction cups

38 rubber fingers

38 rubber beads

40 elastic envelope

50 gelatinous material

60 keyboard

70 internal support members

80 (extended) keyboard with elongated base support

101 irregular shaped keyboard

102 computer mouse

103 embedded wire

DETAILED DESCRIPTION OF PREFERRED EMBODIMENT CONSTRUCTION

Figure 2:
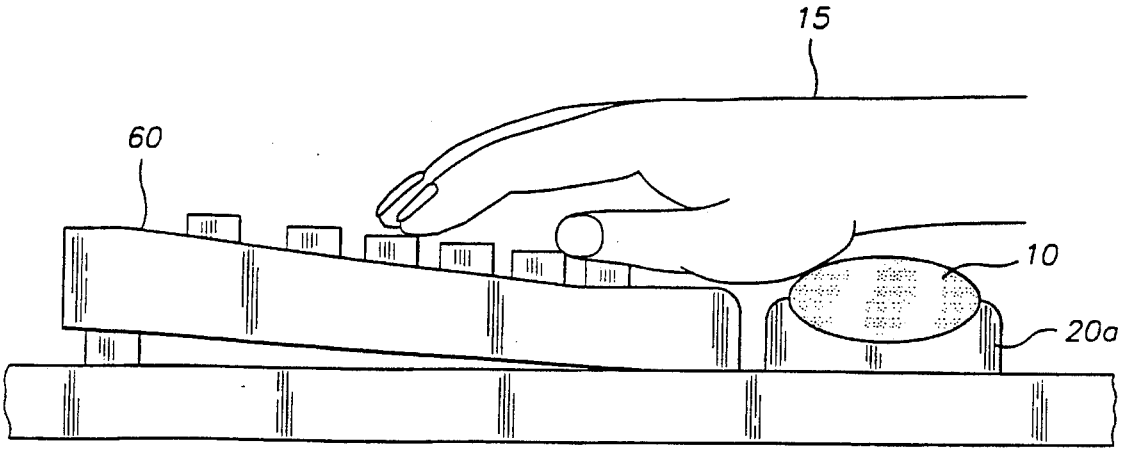
FIG. 2 a view of the wrist rest on a base support with a concave surface positioned relative to keyboard and a user's wrist.

A typical embodiment of a wrist rest comprising the present invention is illustrated in FIG. 2 (end view) and FIG. 1 (perspective view). A wrist rest (10) has in its core resilient, deformable gelatinous material (50). Gelatinous material (50) consists of a solution of glycol-like material, which is highly deformable due to its liquid state and which will be discussed in greater detail below. Gelatinous material (50) is encased in an elastic envelope (40). Elastic envelope (40) provides an encasement for gelatinous material (50) which can stretch to accommodate the increase in volume associated with frozen gelatinous material as discussed below. Elastic envelope (40) consists of an elastic rubber material capable of withstanding impact from being dropped, stepped on, or squeezed, or compressed by the user while exercising, as described below. In the preferred embodiment, elastic envelope (40) consists of a 0.05 mm thick sheet of latex rubber. Envelope (40) contains and protects gelatinous material (50) from rupture and leakage. Illustrated in FIG. 4 (end view) is one embodiment intended for use with inclined keyboards, several flexible internal support members (70) divide the length of the wrist rest (10) into several adjacent tubular structures. Internal support members (70) allow the wrist rest (10) to maintain its relative shape while being used on an inclined surface. Elastic envelope (40) is further encased in an outer cover (30) and may optionally reside on a base (20) for support and orientation. Examples of gelatinous material (50) used in the present invention are: taught by U.S. Pat. No. 4,756,311 to Francis, Jr. (1988), by U.S. Pat. No. 3,874,504 to Verakes, and by U.S. Pat. No. 4,910,978 to Gordon. More specifically, gelatinous material (50) consists generally of the composition as described by Gordon in the '978 patent, consisting of 73–77 percent by weight water, 22–24 percent by weight glycol (freezing point suppressant), and 1–2 percent by weight starch. The deformability of the gel varies inversely with the amount of starch so that increased starch will decrease the deformability. "Deformability" as used herein generally refers to the speed and ability of the wrist rest to conform to the shape of a user's wrist. More particularly, "deformability" refers to the ease at which gelatinous material (50) in a liquid state conforms to the shape of a user's wrist (15) when the weight of a user's wrist (or the weight of both of user's wrists) (15) is applied to gelatinous material (50). Gelatinous material (50) used in the present invention having desirable deformable properties is available under the trade name Zero-Pak (TM) from Zero-Pak Products Ltd., 811 Cundy Ave, New Westminster, B.C. Canada V3M 5P6. By deforming readily to the shape of user's wrist (15) when the weight of wrist (15) is applied to wrist rest (10), the area of contact between user's wrist (15) and wrist rest (10) is increased thereby significantly reducing the amount or severity of pressure felt at any particular point along the base of user's wrist (15). The user does not experience an uncomfortable pressure point between wrist (15) and wrist rest (10).

Selecting gelatinous material (50) having thermally desirable qualities is an important component of the present invention. Gelatinous material may be selected for its ability to be chilled in a refrigerator, where the gelatinous material (50) will readily absorb cold and at normal room temperature will slowly radiate the cold over a period of time, nominally for about 30 minutes. Preferably, gelatinous material (50) will be chilled to a range from about–2 to about 16 degrees Centigrade and can be chilled below the freezing point of the material (50) at the preference of the user. This quality of radiating cold over a period of time is an important aspect of wrist rest (10). When an inflamed user's wrist (15) contacts a chilled wrist rest (15), inflammation is reduced in said wrist. Reducing inflammation contributes to successful treatment of repetitive strain injuries such as Carpal Tunnel Syndrome. Alternatively, in the preferred embodiment of wrist rest (10), gelatinous material (50) can be heated through immersion in hot water or through microwave oven radiation as taught by U.S. Pat. No. 4,756,311 to Francis, Jr. Preferably, gelatinous material (50) should be heated to a range from about 32 degrees to about 50 degrees Centigrade. Following convection or microwave radiation heating, wrist rest (10) can be used as described above to radiate heat to a user's wrist (15) over a period of time, nominally for about 30 minutes. A warm wrist rest provides a soothing remedy for pain of the hands and wrists associated with arthritic type diseases. A variety of gels may be selected for their ability to retain cold or heat, or for an ability to both be cooled and heated as the user may desire and as described above.

Figure 7:
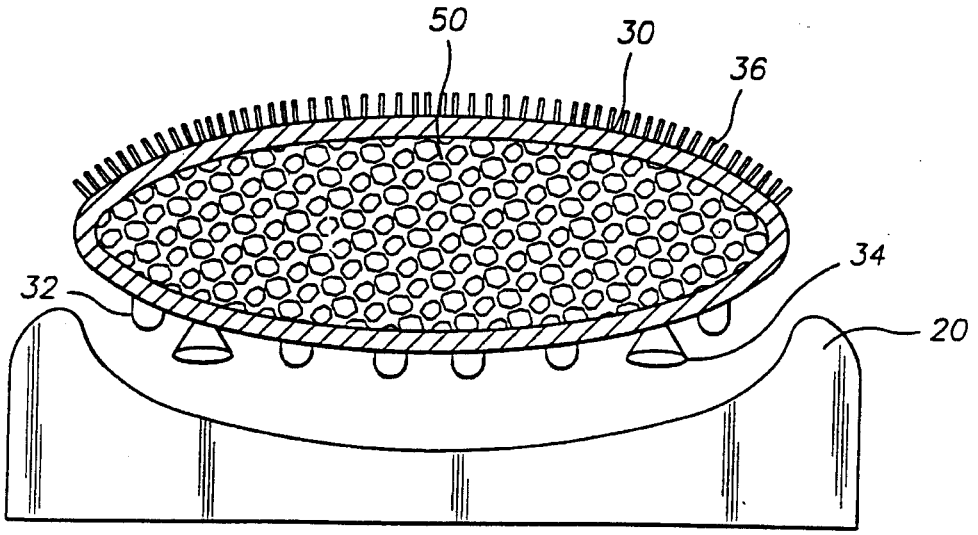
FIG. 7 cut-away view of the wrist rest with its adjoining base, the wrist rest having an outer cover employing rubber feet or suction cups embedded on the lower surface of the outer cover and "fingers" on the upper surface.
Figure 8:
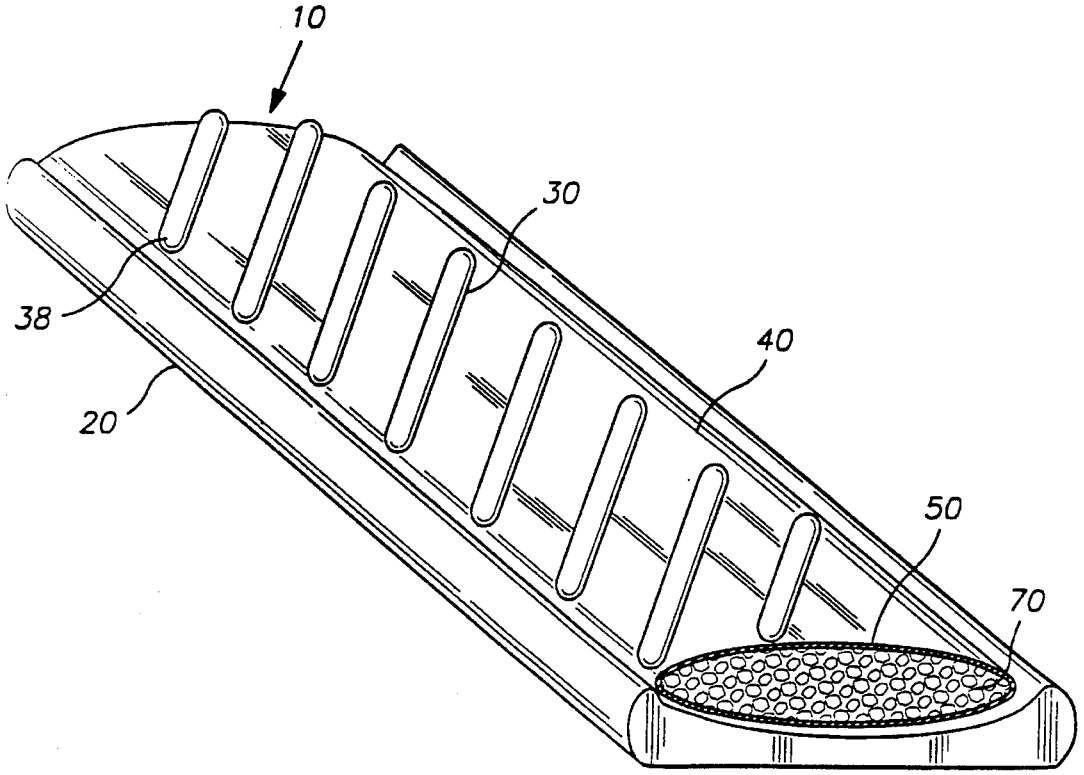
FIG. 8 a perspective view of an outer cover employing a ribbed upper surface for massaging the wrists of a user.

Outer cover (30) is preferably a material that enhances the feel of wrist rest (10), absorbs moisture, protects gelatinous material's core (50) and envelope (40) from puncture, and provides an aesthetic appeal for the present invention. In addition, outer cover (30) should allow a user's wrist to move against wrist rest (10) without generating static electricity, friction or discomfort. Examples of suitable material for outer cover (30) include nylon, cotton, wool, polyester or various fabric blends similar to those used in clothing fabrics. In particular, the specialized blend sold under the trade name "Spandex" (TM) available from the E.I. DuPont Company, New Jersey, is used for outer cover (30) in the present invention. The fabric should preferably be fastened around wrist rest (10) with pins, snaps, velcro, zipper, etc. or folded such that the fabric may be easily removed for cleaning. To improve the seating capability of the wrist rest, outer cover (30) may employ rubber feet (32), suction cups (34) or other frictional devices embedded within or upon the fabric on the lower surface of outer-cover (30), such frictional devices optionally communicating with an upper surface of base (20), keyboard (80) or other support surface, as shown in FIGS. 7 and 8. The use of such frictional devices improves the seating capability of the wrist rest on a support surface. In addition, to improve the comfort and feel of wrist rest (10), outer-cover (30) may optionally employ a variety of different surfaces to massage the wrist of a user. FIG. 7 shows one example whereby rubberized fingers (36), approximately 2 mm to 10 mm long, protrude from an upper surface of outer cover (30). FIG. 8 shows another embodiment, whereby outer cover (30) has rubber beads (38) on its upper surface in communication with the wrists of a user, to massage the user's wrists while the user is typing.

Figure 4:
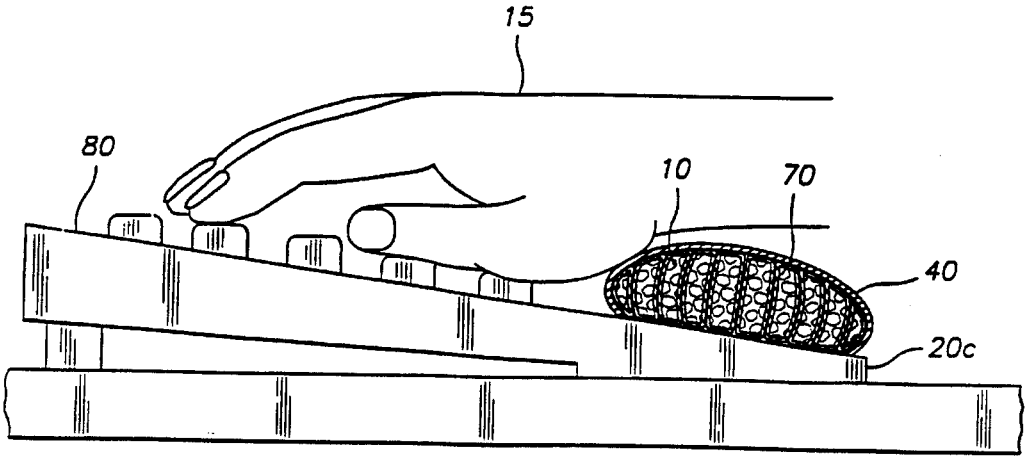
FIG. 4 a view of the wrist rest positioned on an inclined, extended keyboard base.

Wrist rest (10) is intended to be placed in front of and parallel to a leading edge of a computer keyboard or other typing device. The length of wrist rest (10) should run the length of keyboard (60), and outer cover (30) should have substantial height so the overall position of wrist rest (10) will contact a user's wrist or preferably, both of a user's wrists simultaneously. As stated above, wrist rest (10) may optionally reside on a base (20) for support and to properly orient wrist rest (10) relative to a user. The wrist rest embodiment as discussed above may be used wherein base (20) is available from an existing surface. In this embodiment, wrist rest (10) may be used, for example, on an extended keyboard (80) as shown in FIG. 4 wherein the extended surface of keyboard (80) serves as base (20) for wrist rest (10). FIG. 4 shows a wrist rest (10) on an inclined, extended keyboard (80). The internal support members (70)

provide a means to hold, orient and position wrist rest (10) immediately and comfortably beneath a user's wrist. In this embodiment, base (20) (*a*) is made of a rigid material, such as molded plastic.

Figure 3:
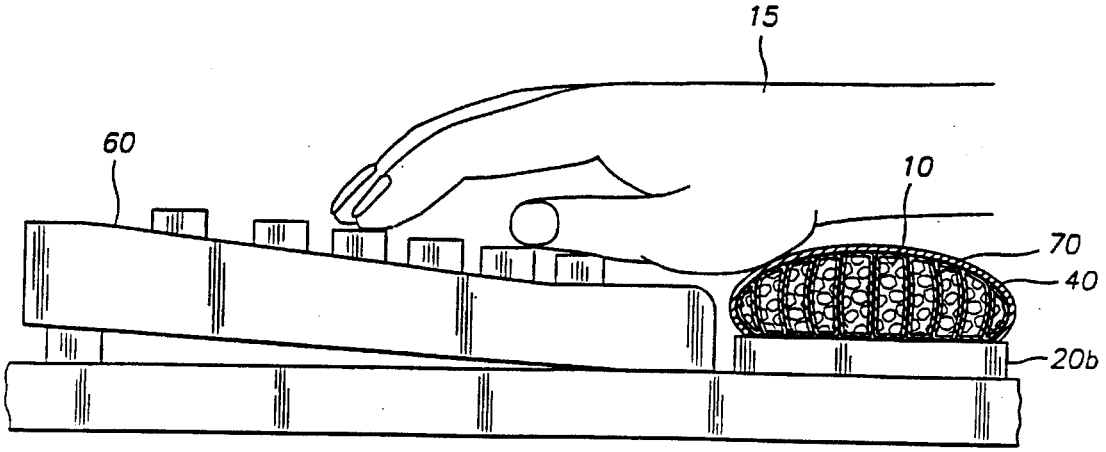
FIG. 3 a view of the wrist rest on a flat base support positioned relative to keyboard and user's wrist.
Figure 6:
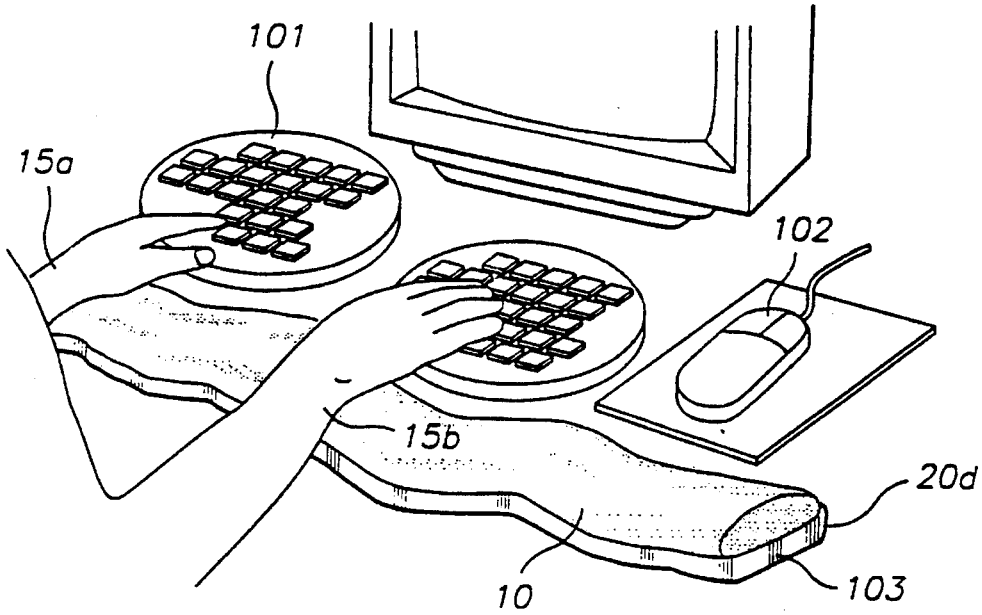
FIG. 6 a perspective view of the wrist rest in an irregular bent shape positioned between the user and keyboard and computer mouse.

In other configurations, base (20) is provided for wrist rest (10) wherein base (20) may be used in conjunction with, or separately from, keyboard (60) or extended keyboard (80). FIG. 3 shows a flat base (20) (*b*) used separately from keyboard (60). In yet another embodiment, base (20) (*d*) comprises a soft flexible material such as foam rubber with a rigid and deformable support material (103) embedded within the flexible material such as 2 mm metal wire. A user may bend or shape base (20) (*d*) into various configurations, and base (20) (*d*) with the rigid, deformable support material (103) embedded therein will maintain such bent shape to hold the shape of base (20) (*d*) and wrist rest (10), as shown by FIG. 6. The wrist rest (10) is positioned in front of a keyboard (101) and or mouse (102) in accordance with the typist's comfort.

In yet another embodiment, base (20) may have a thin (approximately 1 cm) adhesive surface that can be adhered to envelop (40) on the upper surface of base (20). On its bottom surface base (20) can be adhered to a support surface such as extended keyboard (80), foam pad, or table top. The adhesiveness may be provided by glue, velcro or the like.

OPERATION

In operation, FIG. 2 shows wrist rest (10) held in a concave base (20) (*a*) located in a typical position in front of and parallel to a leading edge of a computer keyboard (60) or other typing device. The overall position of wrist rest (10) should be oriented so a user's wrist or preferably, both of a user's wrists (15) will simultaneously contact wrist rest (10) while user is typing on a keyboard.

Figure 5:
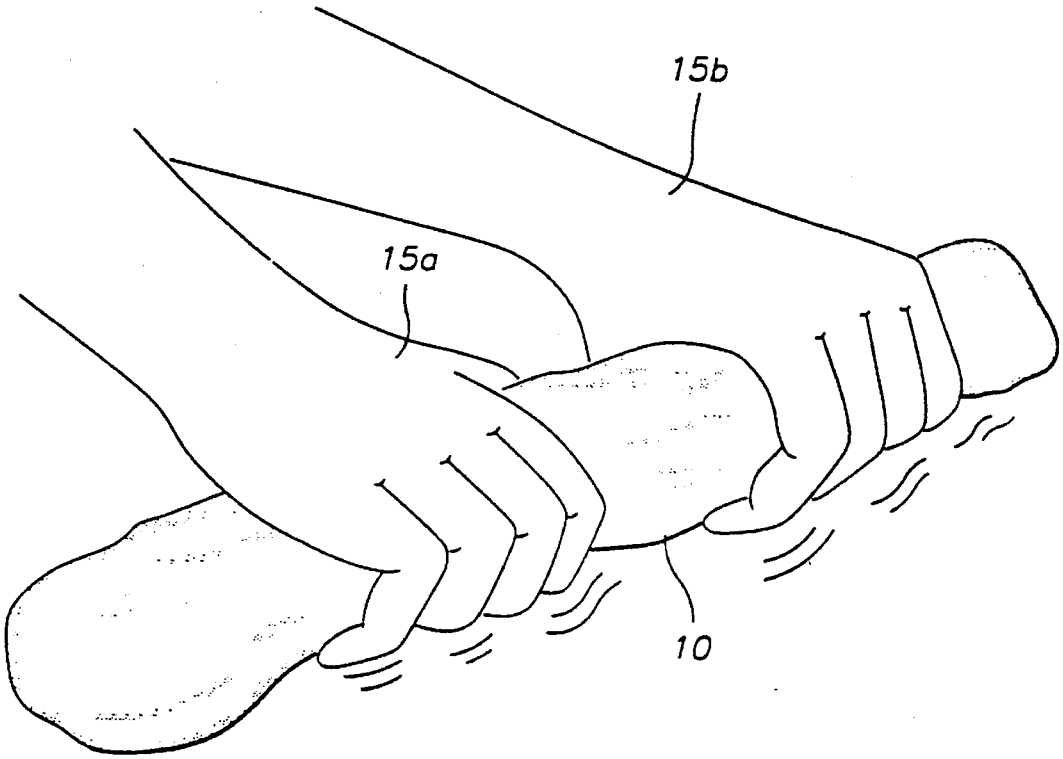
FIG. 5 a perspective view of the wrist rest being squeezed by hands to provide a means of exercise.

The highly liquid nature of the gelatinous core (50) of wrist rest (10) provides a soft and supple resilient feeling to a user placing their wrists on it. The invention may also provide a means of exercise by holding and squeezing wrist rest (10). FIG. 5 shows a typical position for wrist rest (10) when using the invention for exercising. Wrist rest (10) feels both firm and deformable to the touch. Since gelatinous material (50) may flow freely within elastic envelope (40), squeezing a first end of wrist rest (10) will propel gelatinous material (50) freely toward an opposite second end of wrist rest (10). In this way a user can alternately squeeze said first and second ends of wrist rest (10), thereby propelling said gelatinous material (50) within envelop (402) toward user's other hand. A gelatinous material (50) transmits a dynamic force from the squeezing hand which forces open the grasp of the opposing hand. Because the user's hands are opened and closed over a large range of motion, the motion provides an effective means of exercise.

These and other alternatives, derivatives and substitutions that may become apparent to those skilled in the art without departing from the spirit and principles of the matter disclosed and claimed herein are intended to be encompassed within the scope of the invention.

The embodiments of the invention in which an exclusive property or privilege is claimed are defined as follows:

1. A wrist rest and exercise apparatus, for a user's wrists, hands, and fingers comprising, in combination:

a thermally conductive gelatinous resilient means for providing a cushion for a user's wrist, said gelatinous resilient means having a generally deformable surface for providing a contact area shaped to said user's wrist; enveloping means for containing and protecting said gelatinous resilient means; covering means disposed about said gelatinous resilient means on which said user's wrists may be disposed.

2. The apparatus of claim 1 wherein said thermally conductive gelatinous resilient means may be chilled to less than zero degrees Centigrade.

3. The apparatus of claim 1 wherein said thermally conductive gelatinous resilient means may be heated from about 32 to about 50 degrees Centigrade.

4. The apparatus of claim 3 wherein said thermally conductive gelatinous resilient means may be heated using microwave radiation.

5. The apparatus of claim 1 in which said enveloping means is comprised of an elastic envelope.

6. The apparatus of claim 1 in which said covering means comprises a removable fabric.

7. The apparatus of claim 1 in which said covering means contains frictional means embedded within, and protruding throughout, a lower surface of said covering means in communication with a support surface.

8. The apparatus of claim 1 in which said covering means contains massaging means embedded within, and protruding throughout, an upper surface of said covering means in communication with said wrist of said user.

9. The apparatus of claim 1 wherein contained within said enveloping means are internal support means for providing support and shape to said wrist rest.

10. The apparatus of claim 1 further comprising a base support means.

11. The apparatus of claim 10 wherein said base support means, longitudinally, concavely and rigidly seats said wrist rest.

12. The apparatus of claim 10 wherein said base support means consists of flexible material such that it may be shaped by said user.

13. The apparatus of claim 10 wherein said base support means includes means for adhering said wrist rest to said base support means.

14. A method for relieving repetitive motion stress on the wrists of a user while using a device on a work station wherein using said device requires repetitive motion of the fingers and hands, said device including a keyboard and a mouse of a computer, said method including the steps:

positioning on a surface of said work station, and positioned parallel to a leading edge of said keyboard, a relief means with a length substantially equal to said leading edge, a height and a width, said relief means including a deformable thermally conductive gelatinous material having a generally cylindrical shape, a means for containing said gelatinous material, and a fabric covering wrapped around said means for containing said gelatinous material and wherein said height has a value selected to position said wrists on said relief means while using said device.

15. The method of claim 14 wherein said thermally conductive gelatinous material may be chilled below the freezing point of the gelatinous material.

16. The method of claim 14 wherein said thermally conductive gelatinous material may be heated from about 32 to about 50 degrees Centigrade.

17. The method of claim 14 wherein said thermally conductive gelatinous material may be heated using microwave radiation.

18. The method of claim 14 wherein said method further includes manipulation of relief means by a user for exercising the hand and the fingers of the hand.

19. The method of claim 14 wherein said relief means includes a means for providing internal support and shape for said wrist rest.

* * * * *

US005566913C1

(12) EX PARTE REEXAMINATION CERTIFICATE (8827th)

United States Patent
Prokop

(10) Number: US 5,566,913 C1
(45) Certificate Issued: Jan. 31, 2012

(54) WRIST REST APPARATUS

(75) Inventor: David M. Prokop, Redmond, WA (US)

(73) Assignee: David Michael Prokop, Sammamish, WA (US)

Reexamination Request:
No. 90/010,056, Nov. 16, 2007
No. 90/010,078, Dec. 26, 2007

Reexamination Certificate for:

| | |
|---|---|
| Patent No.: | **5,566,913** |
| Issued: | **Oct. 22, 1996** |
| Appl. No.: | **08/455,386** |
| Filed: | **May 31, 1995** |

(51) Int. Cl.
*A47C 5/00* (2006.01)
*B68G 5/00* (2006.01)

(52) U.S. Cl. ..... 248/118
(58) Field of Classification Search ..... 607/109, 607/111; 62/530
See application file for complete search history.

(56) References Cited

To view the complete listing of prior art documents cited during the proceedings for Reexamination Control Numbers 90/010,078 and 90/010056, please refer to the USPTO's public Patent Application Information Retrieval (PAIR) system under the Display References tab.

*Primary Examiner*—Aaron J. Lewis

(57) ABSTRACT

An improved wrist rest (10) is disclosed for reducing repetitive motion strain injuries on the wrists of a typist or computer keyboard operator. Wrist rest (10) is located in front of and parallel to a keyboard (60) or other typing device such that the wrist or wrists (15) of a user is (are) positioned directly over the wrist rest (10) while typing. Wrist rest (10) consists of an elastic envelope (40) filled with a gelatinous material (50) which provides cushioned support for a user's wrists while maintaining the wrist or wrists in a relatively straight position. In some embodiments the gelatinous material (50) can be chilled or heated to provide a source of cold or heat for a period of time. The gelatinous material (40) can be held in place by a base support means (20). In some embodiments wrist rest (10) can be grasped with both hands and squeezed, propelling the gelatinous material within the elastic envelope, thereby functioning as an exercise means for the hands and fingers of the hands.

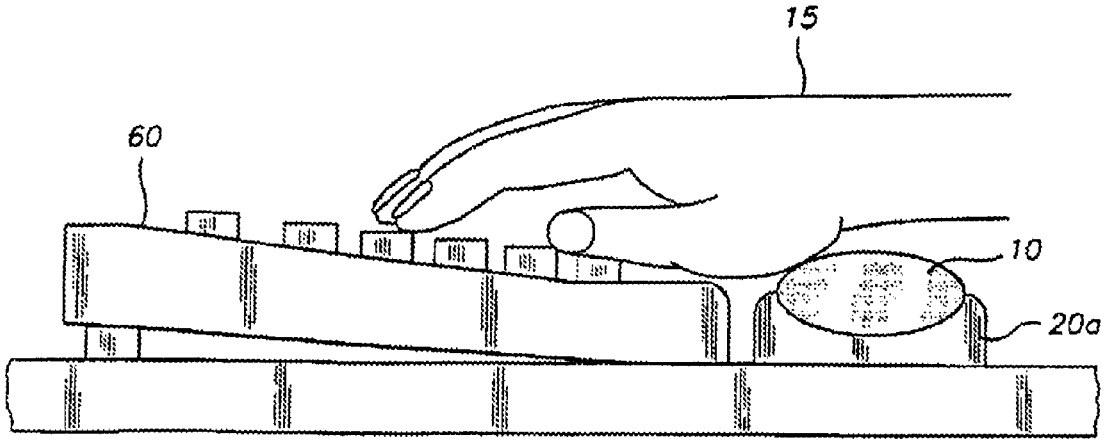

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 3 and 14 are cancelled.

Claims 2, 5-10 and 15-19 are determined to be patentable as amended.

Claims 4 and 11-13, dependent on an amended claim, are determined to be patentable.

New claims 20-37 are added and determined to be patentable.

2. The apparatus of claim [1] *4* wherein said thermally conductive gelatinous resilient means may be chilled to less than zero degrees Centigrade.

5. The apparatus of claim [1] *4* in which said enveloping means is comprised of an elastic envelope.

6. The apparatus of claim [1] *4* in which said covering means comprises a removable fabric.

7. The apparatus of claim [1] *4* in which said covering means contains frictional means embedded within and protruding throughout, a lower surface of said covering means in communication with a support surface.

8. The apparatus of claim [1] *4* in which said covering means contains massaging means embedded within, and protruding throughout, an upper surface of said covering means in communication with said wrist of said user.

9. The apparatus of claim [1] *4* wherein contained with said enveloping means are internal support means for providing support and shape to said wrist rest.

10. The apparatus of claim [1] *4* further comprising a base support means.

15. The method of claim [14] *35* wherein said thermally conductive gelatinous material may be chilled below the freezing point of the gelatinous material, *and further comprising chilling said thermally conductive gelatinous material to below the freezing point of the gelatinous material*.

16. The method of claim [14] *35* wherein said thermally conductive gelatinous material may be heated from about 32 to about 50 degrees Centigrade, *and further comprising heating said thermally conductive gelatinous material to about 32 to about 50 degrees Centigrade*.

17. The method of claim [14] *35* wherein said thermally conductive gelatinous material [may be] *is* heated using microwave radiation.

18. The method of claim [14] *35* wherein said method further includes manipulation of relief means by a user for exercising the hand and the fingers of the hand.

19. The method of claim [14] *35* wherein said relief means includes a means for providing internal support and shape for said wrist rest.

*20. The apparatus of claim 13 wherein said thermally conductive gelatinous resilient means may be chilled to less than zero degrees Centigrade.*

*21. A wrist rest and exercise apparatus, for a user's wrists, hands, and fingers comprising, in combination:*

*a thermally conductive gelatinous resilient means for providing a cushion for a user's wrist, said gelatinous resilient means having a generally deformable surface for providing a contact area shaped to said user's wrist: enveloping means for containing and protecting said gelatinous resilient means: covering means disposed about said gelatinous resilient means on which said user's wrists may be disposed, and a base support means, wherein said base support means includes means for adhering said wrist rest to said base support means, and wherein said thermally conductive gelatinous resilient means may be heated from about 32 to about 50 degrees Centigrade, and wherein said thermally conductive gelatinous resilient means may be heated using microwave radiation.*

*22. The apparatus of claim 13 in which said enveloping means is comprised of an elastic envelope.*

*23. The apparatus of claim 13 in which said covering means comprises a removable fabric.*

*24. The apparatus of claim 13 in which said covering means contains frictional means embedded within, and protruding throughout, a lower surface of said covering means in communication with a support surface.*

*25. The apparatus of claim 13 in which said covering means contains massaging means embedded within, and protruding throughout, an upper surface of said covering means in communication with said wrist of said user.*

*26. The apparatus of claim 13 wherein contained within said enveloping means are internal support means for providing support and shape to said wrist rest.*

*27. The apparatus of claim 29 wherein the thermally conductive gelatinous resilient member is configured to be chilled to less than zero degrees Centigrade.*

*28. The apparatus of claim 29 wherein the thermally conductive gelatinous resilient member is configured to be heated from about 32 to about 50 degrees Centigrade.*

*29. A wrist rest and exercise apparatus: for a user's wrists, hands, and fingers and for use with at least one of a keyboard and computer mouse, comprising:*

*a flexible thermally conductive gelatinous resilient member configured for providing a cushion for a user's wrist that supports the user's wrist in an aligned arrangement relative to the one of the keyboard and the computer mouse and for radiating at least one of cold and heat when in a room temperature environment to the user's wrist over a period of time when the user's wrist is supported by the gelatinous resilient member, the gelatinous, resilient member having a generally deformable surface for providing an adjustable contact area shaped to the user's wrist; a flexible envelope for containing and protecting the gelatinous resilient member: and a cover disposed about the gelatinous resilient member on which the user's wrist may be disposed, said*

*thermally conductive gelatinous resilient member containing thermally conductive gelatinous resilient material that is a sole thermal source that, at room temperature, slowly provides heat or cold to the user's wrist for a period of up to approximately 30 minutes, and wherein the thermally conductive gelatinous resilient member is configured to be heated using microwave radiation.*

*30. The apparatus of claim 29 in which the flexible envelope is an elastic envelope.*

*31. The apparatus of claim 29 further comprising a base that supports the thermally conductive gelatinous resilient member.*

*32. The apparatus of claim 29, further comprising a base that supports the thermally conductive gelatinous resilient member, wherein the base is adhered to the thermally conductive gelatinous resilient member.*

*33. The method of claim 35 wherein said thermally conductive gelatinous material may be chilled below the freezing point of the gelatinous material.*

*34. The method of claim 35 wherein said thermally conductive gelatinous material may be heated from about 32 to about 50 degrees Centigrade.*

*35. A method for relieving repetitive motion stress on the wrists of a user while using a device on a work station wherein using said device requires repetitive motion of the fingers and hands, said device including a keyboard and a mouse of a computer, said method including the steps:*

*positioning on a surface of said work station, and positioned parallel to a leading edge of said keyboard, a relief means with a length substantially equal to said leading edge, a height and a width, said relief means including a deformable thermally conductive gelatinous material having a generally cylindrical shape, a means for containing said gelatinous material, and a fabric covering wrapped around said means for containing said gelatinous material and wherein said height has a value selected to position said wrists on said relief means while using said device wherein said thermally conductive gelatinous material may be heated using microwave radiation.*

*36. The method of claim 35 wherein said method further includes manipulation of relief means by a user for exercising the hand and the fingers of the hand.*

*37. The method of claim 35 wherein said relief means includes a means for providing internal support and shape for said wrist rest.*

* * * * *

US005566913C2

(12) EX PARTE REEXAMINATION CERTIFICATE (10632nd)

United States Patent
Prokop

(10) Number: US 5,566,913 C2
(45) Certificate Issued: Jun. 17, 2015

(54) WRIST REST APPARATUS

(75) Inventor: David M. Prokop, Redmond, WA (US)

(73) Assignee: David Michael Prokop, Sammamish, WA (US)

Reexamination Request:
No. 90/012,124, Mar. 16, 2012

Reexamination Certificate for:

| | |
|---|---|
| Patent No.: | **5,566,913** |
| Issued: | **Oct. 22, 1996** |
| Appl. No.: | **08/455,386** |
| Filed: | **May 31, 1995** |

Reexamination Certificate C1 5,566,913 issued Jan. 31, 2012

(51) Int. Cl.
*A47B 21/00* (2006.01)
*A47B 21/03* (2006.01)

(52) U.S. Cl.
CPC ..... *A47B 21/0371* (2013.01)

(58) Field of Classification Search
None
See application file for complete search history.

(56) References Cited

To view the complete listing of prior art documents cited during the proceeding for Reexamination Control Number 90/012,124, please refer to the USPTO's public Patent Application Information Retrieval (PAIR) system under the Display References tab.

*Primary Examiner* — Patricia Engle

(57) ABSTRACT

An improved wrist rest (10) is disclosed for reducing repetitive motion strain injuries on the wrists of a typist or computer keyboard operator. Wrist rest (10) is located in front of and parallel to a keyboard (60) or other typing device such that the wrist or wrists (15) of a user is (are) positioned directly over the wrist rest (10) while typing. Wrist rest (10) consists of an elastic envelope (40) filled with a gelatinous material (50) which provides cushioned support for a user's wrists while maintaining the wrist or wrists in a relatively straight position. In some embodiments the gelatinous material (50) can be chilled or heated to provide a source of cold or heat for a period of time. The gelatinous material (40) can be held in place by a base support means (20). In some embodiments wrist rest (10) can be grasped with both hands and squeezed, propelling the gelatinous material within the elastic envelope, thereby functioning as an exercise means for the hands and fingers of the hands.

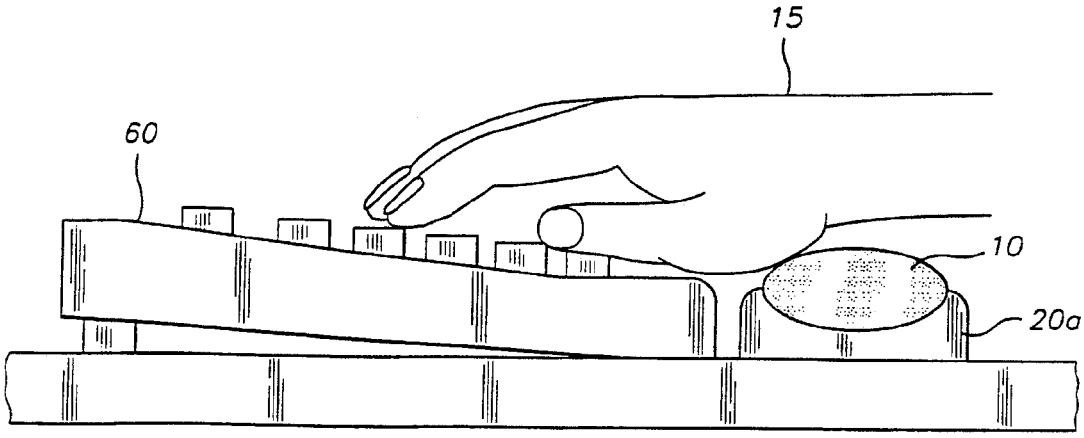

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1, 3 and 14 were previously cancelled.

Claims 2, 4-13 and 15-37 are cancelled.

* * * * *